United States Patent [19]

Vona, Jr. et al.

[11] 4,205,540

[45] Jun. 3, 1980

[54] WASHING MACHINE ADDITIVE DISPENSER WITH SIPHON STARTER

[75] Inventors: Nick Vona, Jr., Springboro; Edward H. Brannen, Centerville, both of Ohio

[73] Assignee: White Consolidated Industries, Inc., Cleveland, Ohio

[21] Appl. No.: 36,818

[22] Filed: May 7, 1979

[51] Int. Cl.[2] ..... D06F 39/02

[52] U.S. Cl. ..... 68/17 R; 68/207; 134/101

[58] Field of Search ..... 68/17 R, 207; 222/204, 222/416; 134/93, 100, 101

[56] References Cited

U.S. PATENT DOCUMENTS

| | | | |
|---|---|---|---|
| 2,976,879 | 3/1961 | DeLisle et al. | 68/17 R X |
| 3,798,932 | 3/1974 | Tromblee | 68/17 R |
| 4,160,367 | 7/1979 | Vona, Jr. | 68/17 R |

*Primary Examiner*—Philip R. Coe

*Attorney, Agent, or Firm*—Pearne, Gordon, Sessions, McCoy & Granger

[57] ABSTRACT

An additive dispensing device including a container, adapted for use with an appliance such as a washing machine. The container has an interior additive receiving space formed in part by side wall means with at least a portion thereof formed with a curved surface. A water inlet spout is adapted to discharge water into the interior space generally tangentially to the side wall curved surface. The spout is located in axial alignment with the space outlet which is in turn in direct fluid communication with a siphon inlet. The space outlet includes a water flow guide portion. Upon water being discharged from the spout the guide portion operates to divert a quantity of the water flow creating a stall-like condition adjacent the space outlet. As a consequence a first portion of the flow is directed into the space outlet and a second portion of the flow enters the space and impinging on the wall curved surface to induce a swirl-like diluting flow therein. The siphon operates, as a result of the first flow portion, through the full range of spout flow rates to induce a full flowing siphon substantially immediately upon the water flow exiting the spout.

1 Claim, 5 Drawing Figures

WASHING MACHINE ADDITIVE DISPENSER WITH SIPHON STARTER

This invention relates to dispensers for an appliance and more particularly to an improved additive dispenser for use with an automatic washing machine.

In the application of various dispensing devices in appliances such as automatic washing machines, those that incorporate siphons have experienced certain limitations. It has been found, for example, that a substantial head must be developed over the siphon point to induce a full flow within the siphon. Such a siphon head arrangement requires a vertical clearance space that may be unavailable in appliances such as automatic clothes washers. A further requirement of liquid dispenser siphons is that the flow rate through the siphon must be matched to the incoming water flow. Thus the water supply flow must be controlled to prevent an overflow condition by exceeding the siphon rate or a siphon break condition by failing to supply an adequate flow rate. The prior art solution to these requirements has been to design an additive siphon for the lowest expected flow rate while providing for higher flow rate by allowing a sufficient volume to create a hydraulic head above the siphon inlet.

Accordingly, it is an object of the present invention to provide an improved additive dispenser wherein a water inlet spout, adapted to discharge water into an interior space of the dispenser container, is located in axial alignment with a space outlet in direct fluid communication with a siphon inlet such that the spout discharges a first portion of its flow directly into the siphon inlet, thereby developing a full flowing siphon substantially immediately, whereby the siphon operates throughout the full range of spout flow rates allowing the dispenser to be timed in conjunction with an automatic washer.

It is another object of the present invention to provide an improved liquid additive dispenser as set forth in the first object and wherein the space outlet includes flow baffle or guide means which operates to cause a second portion of its flow into the dispenser space so as to impinge on a curved wall surface of the container thereby inducing a swirl-like flow in the space to insure the additive will be diluted and flushed from the space by the siphon.

Further objects and advantages of the present invention will be apparent from the following description, reference being had to the accompanying drawings wherein a preferred embodiment of the present invention is clearly shown.

Figure 1:
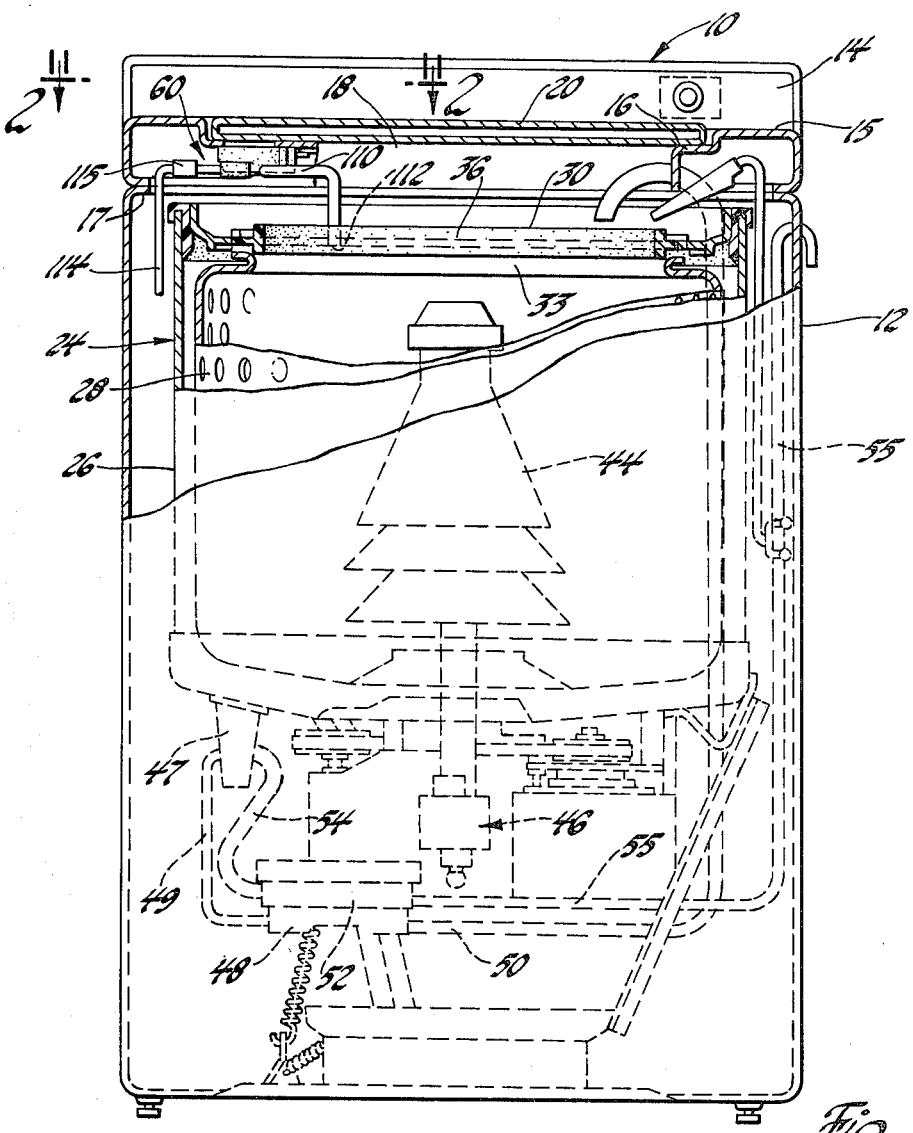
FIG. 1 is a fragmentary vertical sectional view of a domestic clothes washer provided with the additive dispenser of the present invention.

In accordance with this invention and with reference to FIG. 1, the washing machine, partially indicated at 10, is provided with an outer box-like sheet metal cabinet or casing 12 having an upstanding control housing or console 14. The casing has a top panel 15 including a recessed portion 16 defining an access opening 18 in the top panel of the cabinet 12 which is exposed when an access door lid 20 is opened. The cabinet 12 includes a nested tub assembly, generally indicated at 24 and which is shown in more detail in the co-pending U.S. Patent application Ser. No. 941,274—N. Vona, Jr., filed Sept. 11, 1978, entitled "Dual Container Additive Dispenser for Appliance", assigned to the same assignee as the present application, and now U.S. Pat. No. 4,160,367. The tub assembly includes an open top, imperforate wall water container 26 and a perforate wall spin basket 28. An annular plastic subtop 30 is sealingly clamped to the open top of the water container 26. The subtop circumscribes the open top of the water container and extends over a rim 33 forming the top opening of the spin basket 28 to define an access collar 36 between the access opening 18 of the cabinet and the top opening of the spin basket.

The tub assembly 24 includes an agitator, partially indicated at 44, which with the spin basket 28 is connected to a drive mechanism shown generally at 46. The drive mechanism may be of a roller drive type arrangement shown and described in U.S. Pat. No. 3,087,321 to B. L. Brucken, issued Apr. 30, 1963, for example. As explained in the Brucken patent, the mechanism 46 may be operated in one manner to vertically reciprocate or oscillate the agitator 44 for washing clothes in the tub assembly. When the mechanism is operated in another manner, the spin basket 28 is rotated with respect to the water container 26 for centrifuging washing fluid from the clothes in the spin basket.

A conventional water recirculation system for the water container 26 includes a bottom drain sump 47 as described, for example, in the above-mentioned U.S. Patent Application Ser. No. 941,274 to Vona, assigned to the assignee of the present application. A recirculating pump 48 withdraws washing water from the water container 26 through a sump inlet of hose 49 and by means of a recirculating hose 50, returns the washing liquid to the water container 26. A conventional drain system for the clothes washer includes a drain pump 52 for pumping washing liquid from the water container 26 through outlet means in sump 47 and by means of drain conduits or hoses 54 and 55 operate to remove the washing liquid to a remote drain (not shown).

Figure 2:
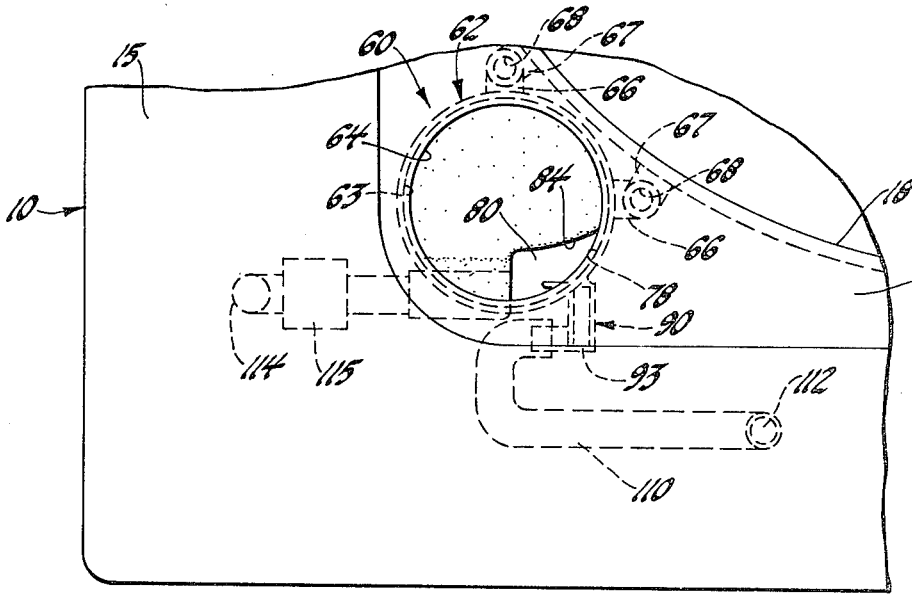
FIG. 2 is a fragmentary enlarged top elevational view, with parts broken away, taken substantially along the line 2—2 of FIG. 1.
Figure 3:
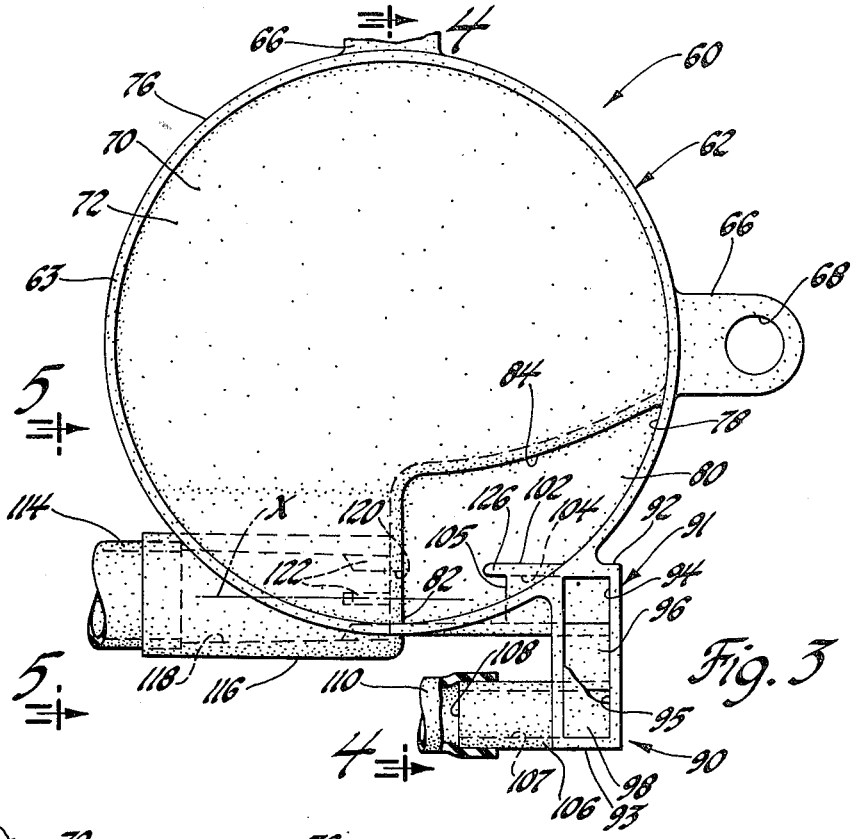
FIG. 3 is an enlarged detail plan view of the additive dispenser.
Figure 4:
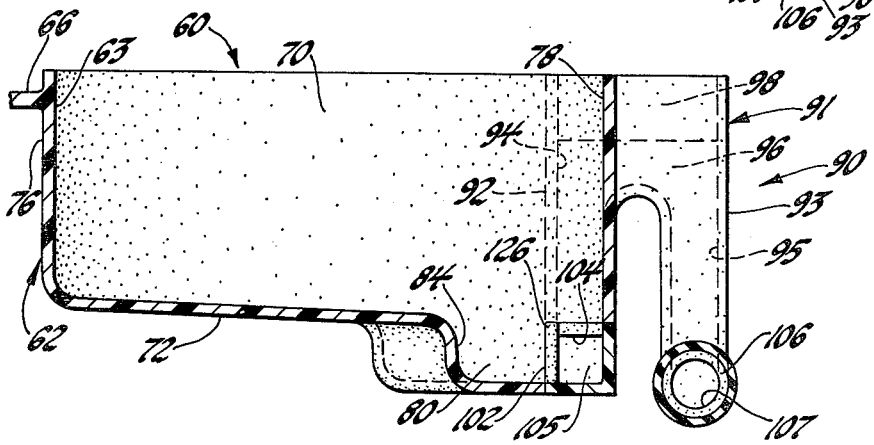
FIG. 4 is a vertical sectional view taken substantially along the line 4—4 of FIG. 3.
Figure 5:
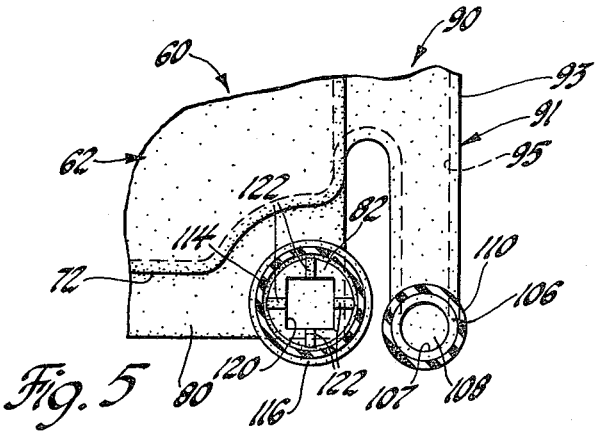
FIG. 5 is an enlarged fragmentary sectional view of the inlet taken substantially on the line 5—5 of FIG. 3, showing portions of the water inlet spout and syphon of the present invention.

In accordance with the present invention, and as seen in FIG. 2, located at the front left-hand corner of the washing machine 10 is an additive dispenser means or apparatus shown generally at 60. The dispenser apparatus includes a liquid additive pour-in cup-shaped container 62 mounted within the cabinet 12 under top 15 with its upper open end 63 aligned with top fill opening 64 permitting the lid 20 to conceal the dispenser apparatus 60 when it is in its lowered or closed position. The container 62 is shown supported in the space between the top 15 and subtop 17 of the water container 26 by a suitable mounting arrangement. As seen in FIGS. 2 and 3, one or more outwardly projecting ears 66, formed integral with the container 62, overly cooperating lug members 67 extending radially from the cabinet portion with threaded fastening members (not shown) extending through aligned openings 68. FIGS. 3-5 illustrate the dispenser apparatus container 62 including an interior space or chamber 70 for receiving an additive to be dispensed. The space is defined by bottom wall means forming a bottom wall 72 and side wall means forming a side wall 76, includes at least a portion thereof formed with a curved surface 78. In the disclosed container the bottom wall 72 is sloped toward recessed portion or sump 80 defined by upright radially extending wall portion 82, arcuate wall portion 84 together with a portion of curved side wall surface 78.

It will be appreciated that the top fill opening 64 could provide access to a plurality of compartments to receive various liquid washing agents, such as a bleach dispenser shown, for example, in the inventor's above-mentioned U.S. Patent application Ser. No. 941,274. While in a preferred form the dispenser apparatus 60 of the present invention will be described for use as a water conditioner or fabric softener dispenser, other additives could be employed or used without departing from the scope of the present invention.

With reference to FIGS. 3–5, the additive dispenser apparatus 60 includes a siphon, generally indicated at 90. The siphon is in the form of a box-shaped housing 91 including a pair of depending rectangular-sectioned legs 92 and 93 integrally joined thereto. The housing defines an inverted U-shaped conduit portion consisting of vertical rectangular-sectioned fluid passages 94 and 95 joined by an upper bight passage 96. As seen in FIG. 3, the siphon bight passage 96 is closed by a cap 98 (FIG. 4) in the form of a box-shaped plug portion adapted for press-fit insertion in the siphon housing top opening.

The lower end of leg 92 is connected to a horizontal container space outlet section 102. Extending through the container space outlet section 102 is a rectangular sectioned passage 104, in fluid flow communication with vertical passage 94, terminating in a rectangular shaped outlet 105 in fluid communication with the container space via sump portion 80. The lower end of the leg 93 is connected to a horizontal outlet section 106. Extending through the outlet section 106 is a circular sectioned passage 107 in fluid flow communication with vertical passage 95 and terminating in siphon outlet 108 adapted to be connected to conduit means, such as J-shaped tube 110. Liquid exits the siphon outlet 108 for flow into the water treatment or washer laundering container 26 via downwardly directed discharge opening 112.

A tube 114 is connected at one end to a water inlet source (not shown) and at its other end to inlet conduit means on the container 62. A solenoid valve 115 (FIG. 1) is provided in line 114 to introduce water into predetermined portion of the washer cycle. In the preferred form the inlet conduit means, integrally formed on the container 62, includes a horizontal conduit 116 having a water supply passageway 118 terminating in a nozzle-like opening or spout 120. As best seen in FIG. 5, the spout opening 120 is located in radial sump wall 82 in the form of a square-shaped spout having four longitudinally extending ribs 122 symmetrically positioned on each side of the spout 120. It will be noted that the passage 118 and its container space discharge spout 120 is aligned on an axis "X" extending generally tangentially to the side wall curved surface 78. As seen in FIG. 3, the container space outlet 105, which provides an outlet on the curved wall surface 78, is aligned with the spout 120 on the axis "X". The outlet 105 is spaced a predetermined distance from the spout 120 with the outlet 105 defined in part by a water flow guide portion 126 extending tangentially from the space outlet 105 a predetermined distance toward the spout 120. In the preferred embodiment the guide portion 126 is in the form of an integral extension of the vertical wall portion of outlet section 102.

In operation, the laundry additive is placed in the chamber space 70 and when it is desired to dispense the additive, wash water is introduced to the dispenser space 70 at the container inlet conduit spout 120 by actuation of the solenoid valve 115. The flow guide portion 126 operates to divert a quantity of flow exiting the spout 120 thereby creating a stall-like condition adjacent the space outlet 105. This results in the spout 120 discharging a first portion of its flow substantially directly into the space outlet 105 and a second portion of its flow into the space 72 via sump 80 so as to impinge on the wall curved surface 78. Applicants' dispenser, by inducing vortex action of the flow second portion in the space 72, causes the water to swirl the additive, such as a concentrated liquid fabric softener, in the space 72 to provide proper mixing and dilution of the additive before it reaches the laundry receptacle while achieving a self-cleaning or flushing effect for the container space. The above-mentioned stall-like condition or action may be defined as a hydraulic separation caused by the accumulation of stagnant fluid at the container space outlet 105.

The siphon 90 operates as a result of the spout 120 discharging the first portion of its flow substantially directly into the space outlet 105 to induce a full flowing siphon substantially immediately upon the water flow exiting the spout. Applicants' invention thus compensates for a range of inlet flow rates allowing the dispenser to be timed or sequenced in the washing cycle because a full flowing siphon is immediately started.

While the embodiment of the invention as herein disclosed constitutes a preferred form, it is to be understood that other forms might be adopted.

The embodiments of the invention in which an exclusive property or privilege is claimed are defined as follows:

1. For use in an automatic washing machine having a receptacle for receiving laundry and pump means for providing water flow; an additive dispenser comprising, a container having bottom wall means and side wall means defining an interior space for receiving an additive to be dispensed, said side wall means having at least a portion thereof formed with a curved surface, inlet conduit means on said container including a water inlet at one end in communication with the water flow from said pump means, said inlet conduit means terminating in a spout at its other end adapted to discharge water into said space, said spout aligned on an axis extending generally tangentially to said side wall curved surface, outlet conduit means on said container providing an outlet in said curved wall surface for discharging liquid from said space, said space outlet aligned on said axis a predetermined distance from said spout, said space outlet defined in part by a water flow guide portion extending tangentially from said space outlet a predetermined distance toward said spout, whereby said flow guide portion operates to divert a quantity of the water flow exiting said spout thereby creating a stall-like condition adjacent said space outlet, whereby said spout discharges a first portion of its flow substantially directly into said space outlet and a second portion of its flow into said space so as to impinge on said wall curved surface thereby inducing a swirl-like flow of said second portion in said space, said dispenser including an inverted U-shaped siphon thereon including an inlet and an outlet, said siphon inlet in direct fluid communication with said space outlet and said siphon outlet in fluid communication with said receptacle, whereby said siphon operates as a result of said first flow portion throughout the full range of spout inlet flow rates to induce a full flowing siphon substantially immediately upon the water flow exiting said spout, and whereby said second swirl-like flow portion mixing with the additive in said space such that the additive will be thoroughly diluted by said second swirl-like flow portion and flushed from said space by the full flowing siphon to admix with the fluid in the receptacle.

* * * * *